United States Patent [19]

Webster

[11] 4,220,260

[45] Sep. 2, 1980

[54] TUBE CADDY AND DISPENSER FOR COLLAPSIBLE TUBES

[76] Inventor: Loresta M. Webster, Rte. 2, Box 260W, Conroe, Tex. 77302

[21] Appl. No.: 754,820

[22] Filed: Apr. 19, 1977

[51] Int. Cl.[2] ..... B65D 35/28

[52] U.S. Cl. ..... 222/100

[58] Field of Search ..... 222/100, 101, 105

[56] References Cited

U.S. PATENT DOCUMENTS

| | | | |
|---|---|---|---|
| 2,214,507 | 9/1940 | Manning | 222/100 X |
| 2,567,629 | 9/1951 | Veon et al. | 222/100 |
| 2,600,553 | 6/1952 | Lord | 222/100 |
| 3,221,940 | 12/1965 | Watson, Jr. | 222/105 X |
| 3,241,721 | 3/1966 | Freeman | 222/100 X |
| 3,257,039 | 6/1966 | Tvutza | 222/105 X |
| 3,780,911 | 12/1973 | Paige | 222/101 |

*Primary Examiner*—David A. Scherbel

[57] ABSTRACT

A tube caddy and dispenser for dispensing paste from collapsible toothpaste tubes is provided for attachment to walls. The dispenser caddy has two opposing vertically extending slots in opposing side walls of the dispenser to allow for the movement of the winding shaft key to travel therethrough. The bottom of the dispenser caddy is open to receive the toothpaste tube, which in turn, is supported by its neck by prongs in an opening in the bottom unit. The bottom unit has horizontal grooves which cooperate with pegs which extend from the bottom of the dispenser caddy to retain the bottom unit.

1 Claim, 5 Drawing Figures

TUBE CADDY AND DISPENSER FOR COLLAPSIBLE TUBES

FIELD OF THE INVENTION

This invention relates to a novel dispenser designed for use with tooth paste and other similar tubes.

The prior art as illustrated of various devices of this type, is generally acceptable for their intended purpose, however each has components difficult to fabricate or capable of being utilized as being successful in their field of purpose.

OBJECT OF THE INVENTION

It is the primary object of the invention to provide a caddy and dispenser combination which enables easy and uniform dispensing of a product from a collapsible tube.

A further objective is the holder being adapted to be mounted on a wall with the use of the screw or the peel-off tape gummed so as to adhere to a wall surface, walls such as bathroom, nursery, kitchen and workroom using a desired product in each location, thus providing a manually operated means for forcing contents of the tube, in desired amounts by the use; and to provide a dispensing tool, which is the shaft key designed with leverage type knobs located on right and left sides of caddy, which will allow for each turning force in either direction, backward or forward.

Basically, the object is to eliminate the waste that is associated with the use of such a tube, to maintain the tube in a sanitary condition, and to offer a caddy and dispenser for collapsible tubes that is easy to use and attractive in appearance.

These and other advantages and objectives of this invention will be readily apparent from the following detailed description of an embodiment thereof and the accompanying drawings.

FIG. 1. Shows a perspective view of side, front and top with bottom unit detached from tube caddy.

FIG. 2. Shows grooved shaft key with left knob removed.

FIG. 3. Shows removable bottom base unit, with hinged cover opened revealing flushing holes in closure cap.

FIG. 4. Shows side view of tube caddy with bottom unit intact and closure cap closed.

FIG. 5. Shows sectional side view of tube caddy with tooth paste tube in view and a modified form of closure cap mounting.

DETAILED DESCRIPTION OF AN EMBODIMENT OF THE INVENTION

Figure 1:
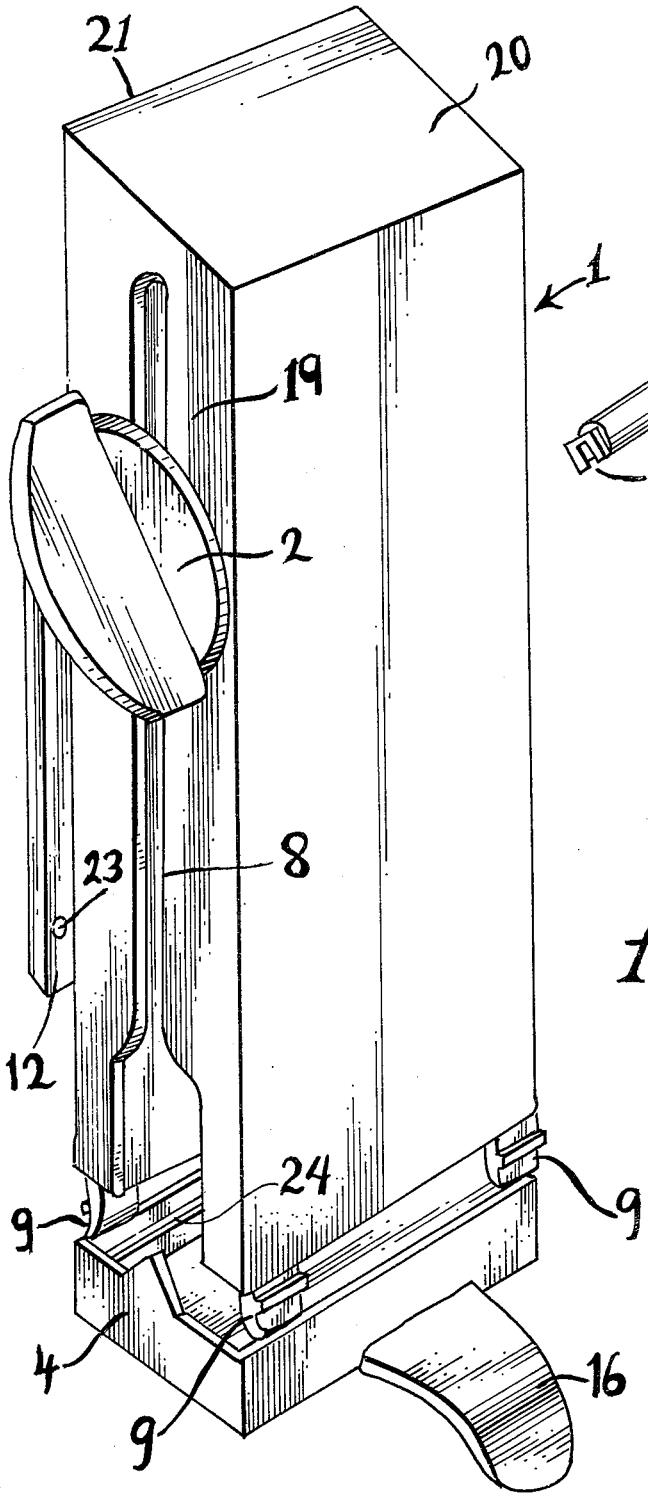
Figure 2:
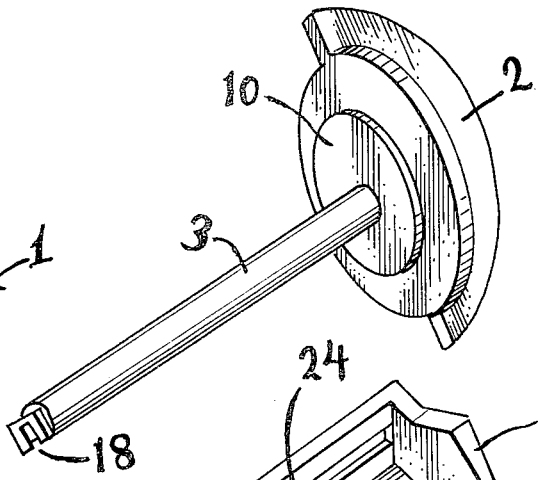
Figure 3:
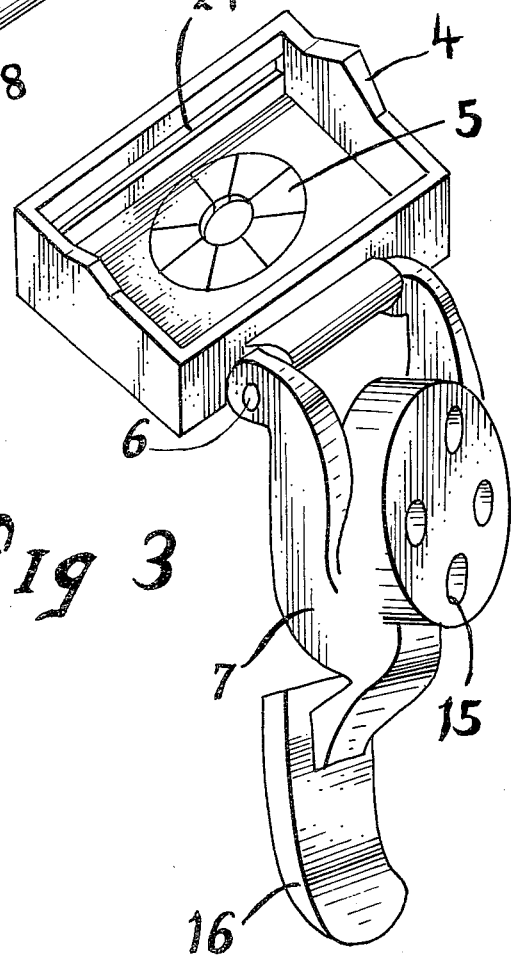
Figure 4:
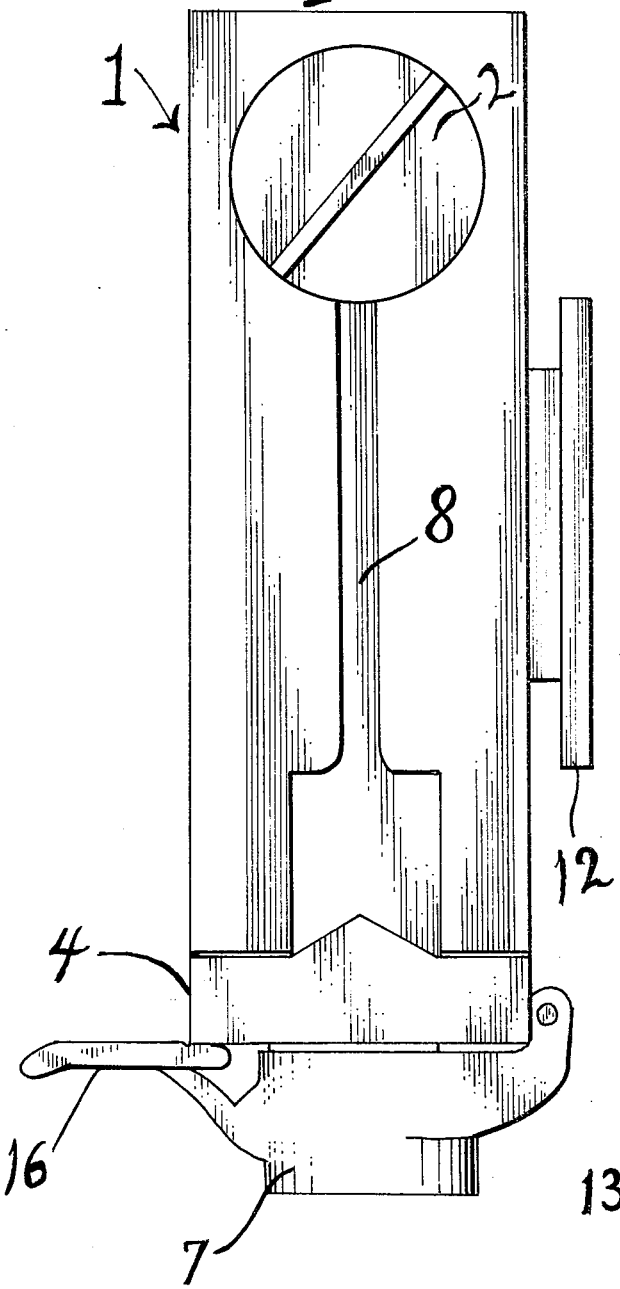
Figure 5:
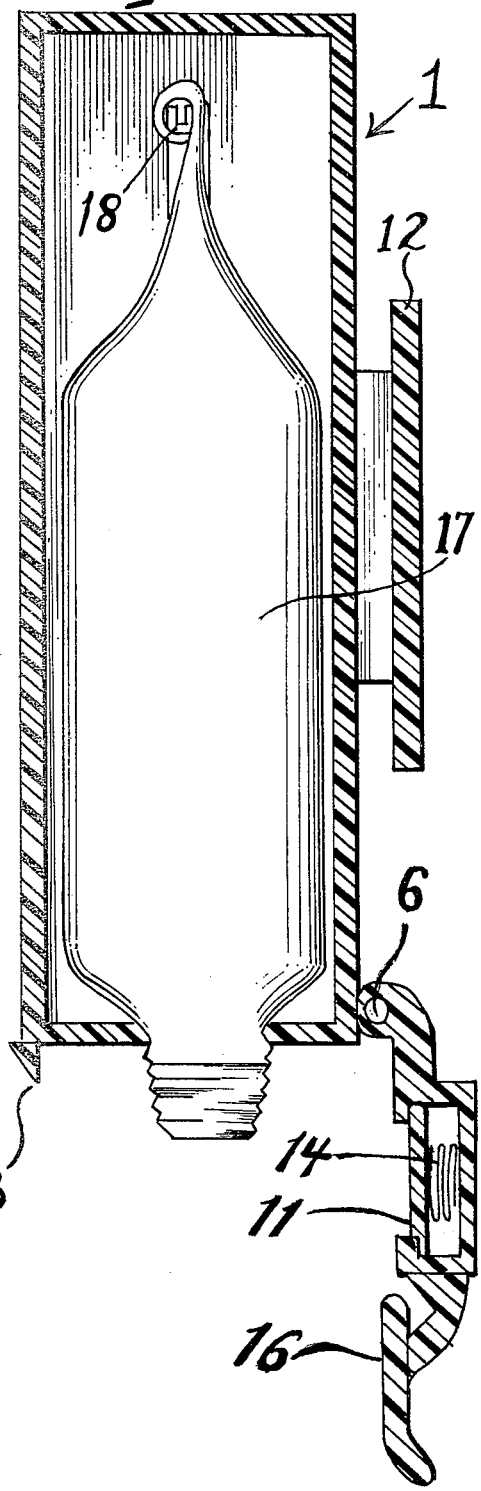

In FIG. 1 there is illustrated a collapsible tube caddy dispenser designated at 1, consisting of a casing, rectangular in configuration and cross section, and formed of plastic or any other suitable material. The device has opposed side walls 19,19, rear wall 12, and top wall 20. The bottom of the casing is open but is adapted to be closed by a bottom unit 4, which is comprised of the closure cap mounting 7, which has a hinged member 6. The side walls 19,19, form an equal distance from the top wall 20, to the bottom end thereof. The side walls 19, 19, have elongated slots 8,8 extending longitudinally and substantially along the mid-width location of the side walls, allowing for the shaft key 3, to slide upwardly into the receptacle thus providing a guide for the disks 10, 10, located on shaft key 3. The disks work with the knobs 2, 2, like a spool allowing just enough space between disk and knob to ride smoothly along elongated slots in the casing, thus giving firm control on key shaft 3, at all times during the dispensing of a product from a tube. The shaft key 3, provides an elongated groove 18, to receive the butt end of a conventional collapsible tube 17, as shown in FIG. 5. The left knob is removed for the shaft 3, to receive the butt end of a tube, and replaced to its respective position to be used as a dispensing device. The bottom unit 4, receives the threaded neck of a collapsible tube as shown in FIG. 3. The threaded neck of the tube is pushed through the flexible pronged opening 5, in the bottom unit so that the end of the prongs engage in the threads on the neck of the tube. The ends of the prongs at the opening 5, are preferably staggered in length for different size tube heads. The closure cap 7, being located on the underside of bottom unit 4, opens and closes on a hinged member 6, which allows the cap with finger lift 16 to be open and closed easily. The cap also provides a coil spring 14, housed in the interior of the lid, which causes pressure against a sealer plate 11, also housed in the upper part of the lid, to apply pressure against tube head, thusly sealing product in tube while not in use. Lid closure 7, also provides holes 15, in order to irrigate the cap with tap water while pressing up and down on pressure plate 11, and coil spring 14, thus causing accumulated product to be washed away. Also this irrigating procedure can be done at any time without interfering with despensing of a tube.

In order to mount a tube in the caddy, having the tube head in it's respective position in prongs 5 and butt end of tube on shaft key 3 and left knob on it's respective end 18, the tube 17 and bottom unit 4 are then slipped into caddy.

Pegs 9,9,9,9 located on the four bottom corners of caddy 1, and having horizontal shoulders projecting outwardly therefrom are extensions to lock onto bottom unit 4, in association with grooves 24 provided therein. Protruding lip 13, on bottom mid-section of caddy, works in association with finger lift 16, for a firm overlock hold for sealing the tube head.

To disassemble and replace a used tube, a slight point of pressure on bottom of caddy releases bottom unit 4, from pegs 9, 9, 9, 9.

The rear wall 21, of caddy 1, is provided with an extended wall plate 12, with aligned holes 23, shown in FIG. 1, to receive screws, or more preferably adhesive peel off tape for fastening the caddy to a vertical support.

Now that I have illustrated and described the preferred embodiments of my invention, it is to be understood that various changes and modifications may be made within the scope of the invention as defined in the appended claim.

What is claimed:

1. A rectangular casing having top, rear, front and side walls and open at the bottom to receive a collapsible tube; said side walls having elongated vertical slots; a grooved shaft key adapted to extend through both of said elongated slots to received the butt end of a tube placed therein; knobs located on the ends of the shaft key for placement outside of the side walls of the casing when the shaft key is placed through the elongated slots; a plurality of pegs located on the bottom of the casing, said pegs each having an outwardly extending horizontal shoulder; a bottom unit having a flexible pronged opening formed in the bottom thereof for receiving the neck of a tube placed there through; said bottom unit further having a closure cap hinged thereto for pivotal movement between a sealing position and a non-sealing position, said closure cap further including a pressure plate and a spring located between said cap and said plate for biasing said plate in sealing contact against the opening in the neck of the tube when said cap is in said sealing position; and said bottom unit further including walls corresponding to the front and rear walls with each wall having a horizontal groove located on the inside thereof to cooperate with said shoulders on said pegs for retaining said bottom unit on said casing.

* * * * *